US006675981B1

(12) United States Patent
Lesko

(10) Patent No.: US 6,675,981 B1
(45) Date of Patent: Jan. 13, 2004

(54) MIND DEVELOPMENT DUAL BABY BOTTLE AND DRINKING STRAW NIPPLE

(75) Inventor: Joseph John Lesko, 3419 Via Lido Ste 204, Newport Beach, CA (US) 92663

(73) Assignee: Joseph John Lesko, Huntington Beach, CA (US)

( * ) Notice: Subject to any disclaimer, the term of this patent is extended or adjusted under 35 U.S.C. 154(b) by 0 days.

(21) Appl. No.: 08/944,613

(22) Filed: Oct. 6, 1997

(51) Int. Cl.[7] ..... A61J 9/00

(52) U.S. Cl. ..... 215/11; 215/388; 215/11.6

(58) Field of Search ..... 215/11.1, 11.4, 215/11.6, 388; 64/77, 79; 606/235; 220/705, 708

(56) References Cited

U.S. PATENT DOCUMENTS

| | | | | | |
|---|---|---|---|---|---|
| 224,557 | A | * | 2/1880 | Potter | 215/11 R |
| 605,161 | A | * | 6/1898 | Clement et al. | 215/11.1 |
| 1,913,627 | A | * | 6/1933 | Epstein | 215/11.1 |
| 1,998,646 | A | * | 4/1935 | Yagen | 215/11 B |
| 2,025,508 | A | * | 12/1935 | Herstein | 215/11 R |
| 2,093,730 | A | * | 9/1937 | Kurkjian | 215/11 R |
| 2,223,179 | A | * | 11/1940 | Lougheed | 215/11.1 |
| 2,366,214 | A | * | 1/1945 | Ramaker | 215/11.1 |
| 2,388,915 | A | * | 11/1945 | Heilborn | 215/11.1 |
| 2,588,991 | A | * | 3/1952 | Schellin | 215/11 R |
| 2,811,271 | A | * | 10/1957 | Kurkjian | 215/11 R |
| 2,889,064 | A | * | 6/1959 | Kurkjian | 215/11 R |
| 2,956,702 | A | * | 10/1960 | Ransom | 215/11 R |
| 2,960,088 | A | * | 11/1960 | Witz | 215/11 X |
| 2,982,432 | A | * | 5/1961 | Mehl | 215/11 R |
| 2,987,208 | A | * | 6/1961 | Ransom | 215/11 R |
| 3,126,116 | A | * | 3/1964 | Chinehens | 215/11 R |
| 3,544,281 | A | * | 12/1970 | Phillips | 215/274 X |
| 3,549,036 | A | * | 12/1970 | Ritsi | 215/11 C |
| 3,858,738 | A | * | 1/1975 | Hurst | 215/11 C |
| 3,946,888 | A | * | 3/1976 | Tonkin | |
| 4,238,040 | A | * | 12/1980 | Fitzpatrick | 215/11 E |
| 4,685,577 | A | * | 8/1987 | Chen | 215/11.4 X |
| 4,765,497 | A | * | 8/1988 | Hsu | 215/11.1 |
| 5,553,726 | A | * | 9/1996 | Park | 215/11.1 X |
| 5,573,507 | A | * | 11/1996 | Moser et al. | 215/11.1 X |

FOREIGN PATENT DOCUMENTS

| | | | | |
|---|---|---|---|---|
| DE | 150789 | * | 4/1904 | 215/274 |
| DE | 2364102 | * | 7/1974 | 215/11 R |

* cited by examiner

*Primary Examiner*—Tri M. Mai
(74) *Attorney, Agent, or Firm*—Stetina Brunda Garred & Brucker

(57) ABSTRACT

Two baby bottles 33 that are attached to each other as to dispense two separate liquids and having baby size handles 30 for holding and attached to handles are mind development keys 31. A drinking nipple 10 so constructed as to accommodate a common drinking straw. A teething nipple 38 and 39 with a dispensing cavity 40 governed by an attached baffle 41 which restricts the flow of liquids and said baffle 41 designed to hold a drinking straw if so desired without spilling contents of bottle when inverted.

5 Claims, 9 Drawing Sheets

MIND DEVELOPMENT DUAL BABY BOTTLE AND DRINKING STRAW NIPPLE

FIELD OF THE INVENTION

This invention relates to a baby bottle and a baby bottle nipple, and, more particularly, is directed towards such a combination of feeding baby and developing its mind and raising the awareness in the human mind at the same time the baby is feeding; baby's first mode of learning and mind development is through its mouth and hands. A dual bottle so attached as to provide easy cleanability together with handles to provide grips for baby and a drinking straw nipple to provide a means of feeding between bottle and cup stages.

BACKGROUND OF THE INVENTION

Bottles and nipples for dispensing liquids or foods from baby bottles and jars are well known.

SUMMARY OF THE INVENTION

It is therefore an object of this invention to provide a baby bottle and nipple which when used will give baby a choice and when there is a choice involved, natural thinking will occur, and then the baby will then se apt to make its mind develop every time feeding or drinking occurs. It is common knowledge that our first mode of mind development is through the mouth, fingers and tongue.

BRIEF DESCRIPTION OF THE DRAWINGS

The accompanying drawing illustrates the invention. In such drawings.

DETAILED DESCRIPTION OF THE PREFERRED EMBODIMENT

Figure 1A:
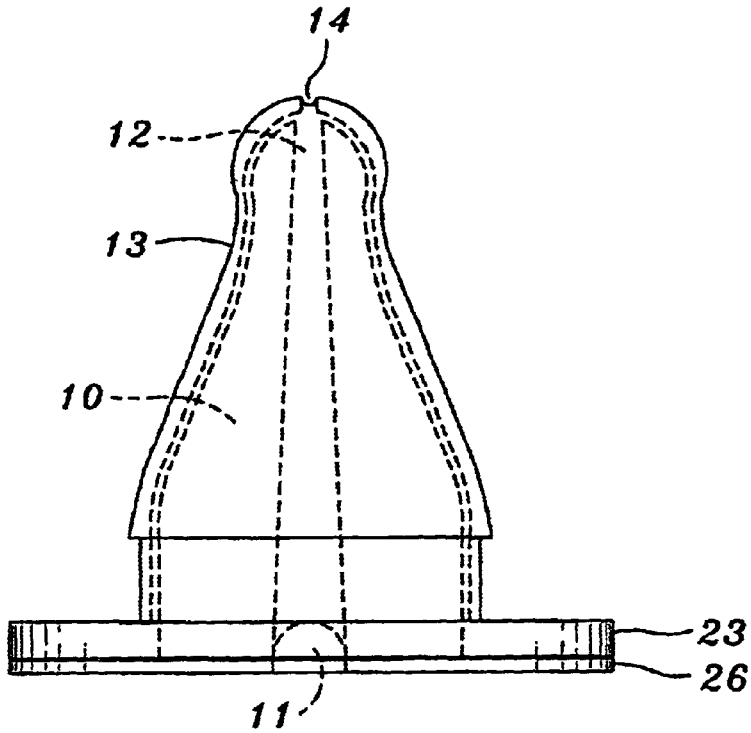
FIG. 1*a* is a front view of a nipple according to this invention with a nipple shown in phantom outline inside the cavity of a conventional on common nipple.
Figure 1B:
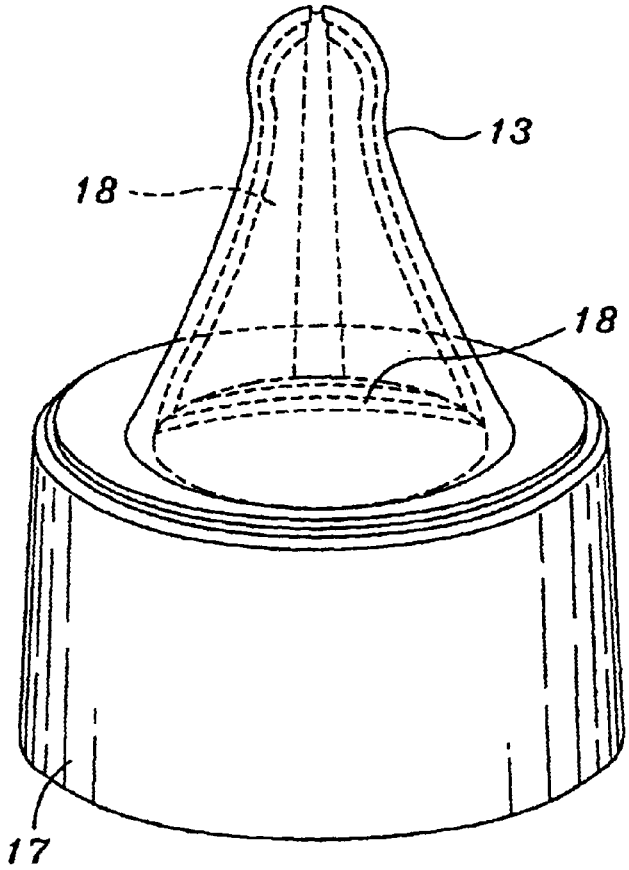
FIG. 1*b* is a front perspective view of the nipple engagable to a collar.

FIG. 1 shows a rubber nipple 13 for a baby bottle that dispenses liquids or foods. Collar 17 is made typically from injection molded plastic, or any other boilable material that can be sterilized before use. Collar 17 then holds nipple 13 on bottle or food jar by standard thread 18 inside the collar as in FIG 1 the collar 17 is then screwed onto an ordinary baby bottle or food jar until the base 23 of the nipple is compressed and seated against the rim 24 of the bottle.

Figure 2A:
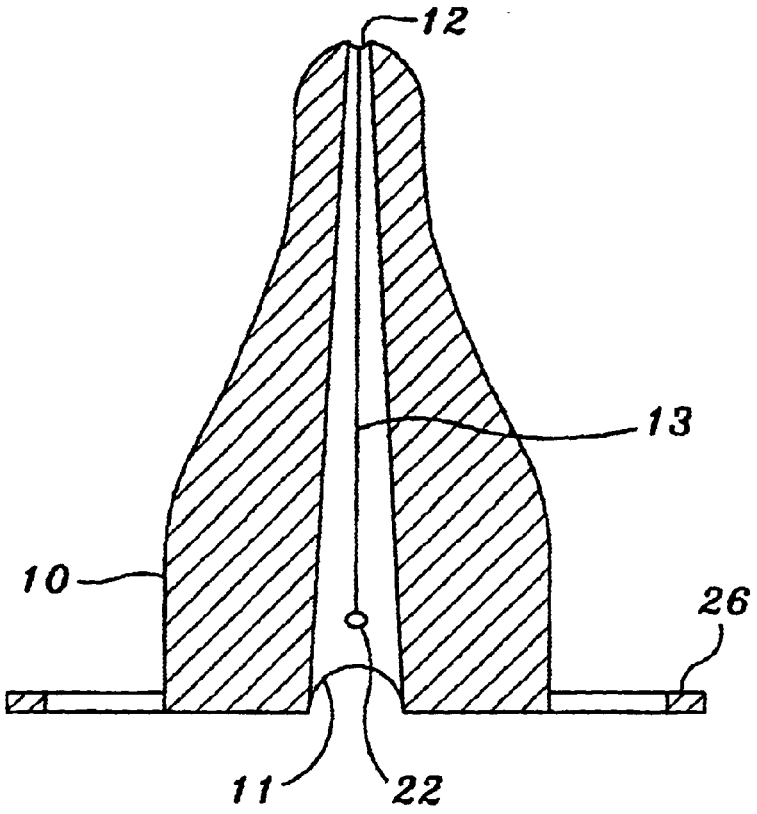
FIGS. 2*a* and 2*b* shows a section view and a bottom view respectively of the nipple according to this invention.
Figure 2B:
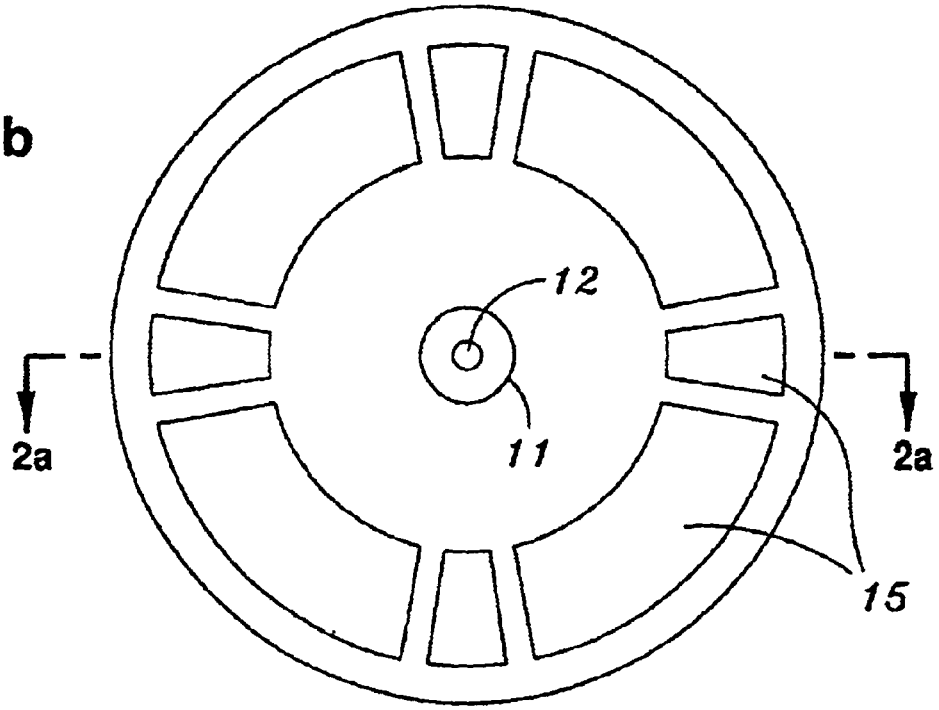
Figure 3:
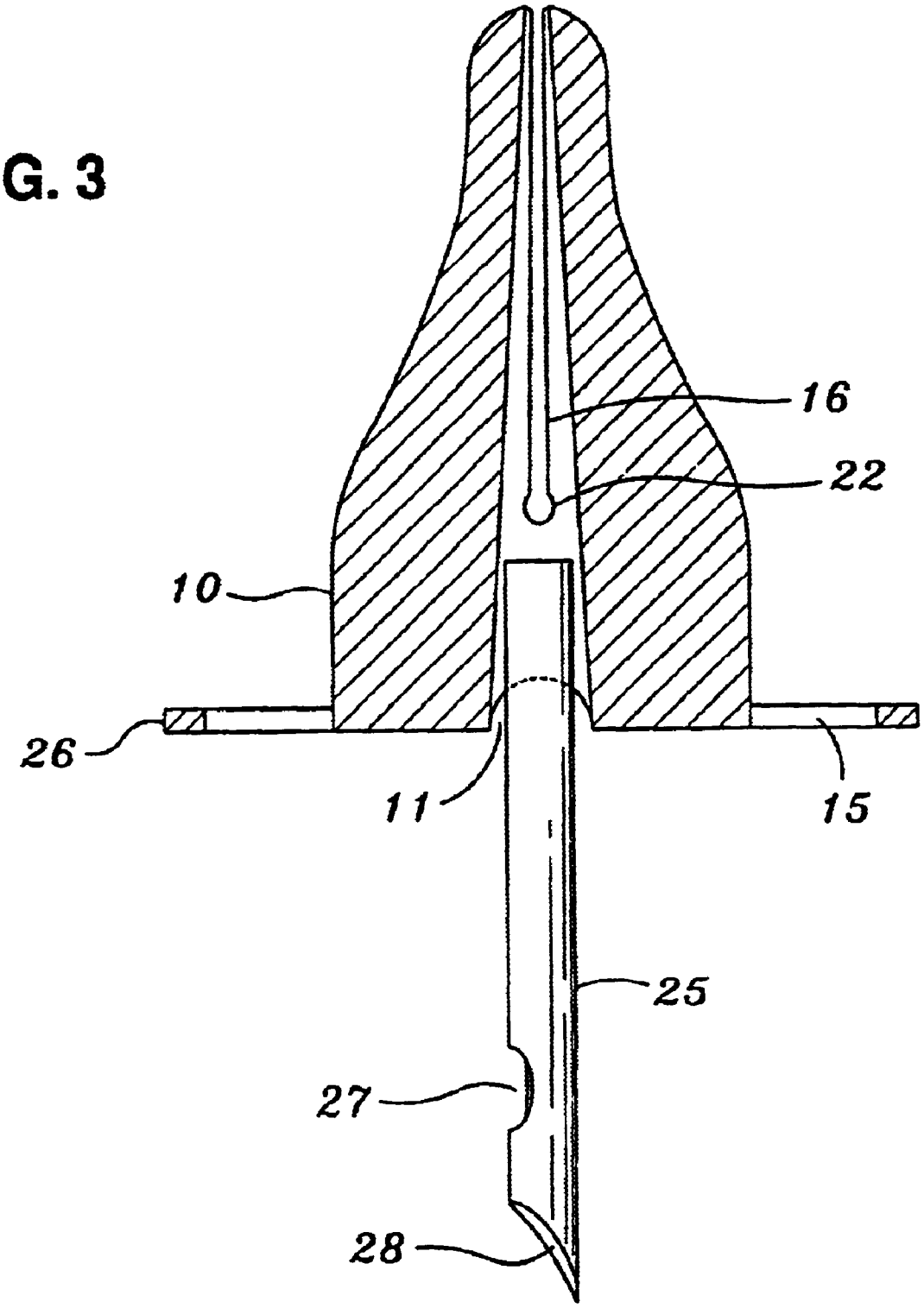
FIG. 3 is a section view of the nipple showing a common plastic drinking straw frictionally secured in the tapered cavity of the nipple according to this invention.
Figure 6:
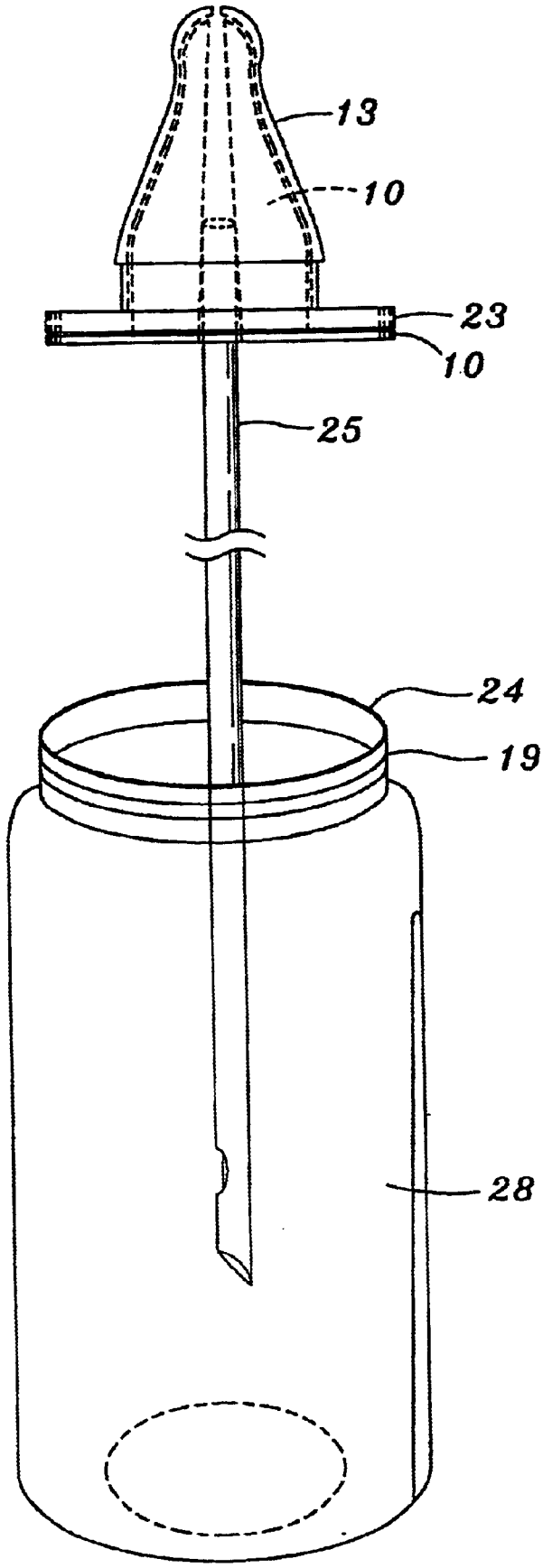
FIG. 6 shows a common nipple with a nipple, according to this invention, shown in phantom outline with common plastic drinking straw, inserted in phantom outline in the nipple of this invention, being placed inside of a common baby bottle.

The nipple 10 of the present invention is shown in FIG. 2 is typically made from rubber or from injected molded plastic such as polyethylene or any other boilable material that can be sterilized before use. The drinking straw tapered entry hole 11 terminates at the top of the nipple at 12. The hole in the nipple of the present invention is tapered allowing any size diameter drinking stray as illustrated on FIG. 3. Drinking straw 25 in FIG. 3 enters nipple 10 at tapered entry hole 11 at base 26 of nipple of the present invention. Drinking straw 25 is held by friction in tapered cavity of the present invention. The drinking straw 25 is then cut in such a manner as to let fluids or foods enter straw at 27 or 28. Length of drinking straw is determined by depth of container 20 as illustrated in FIG. 6.

Figures 4A, 4B:
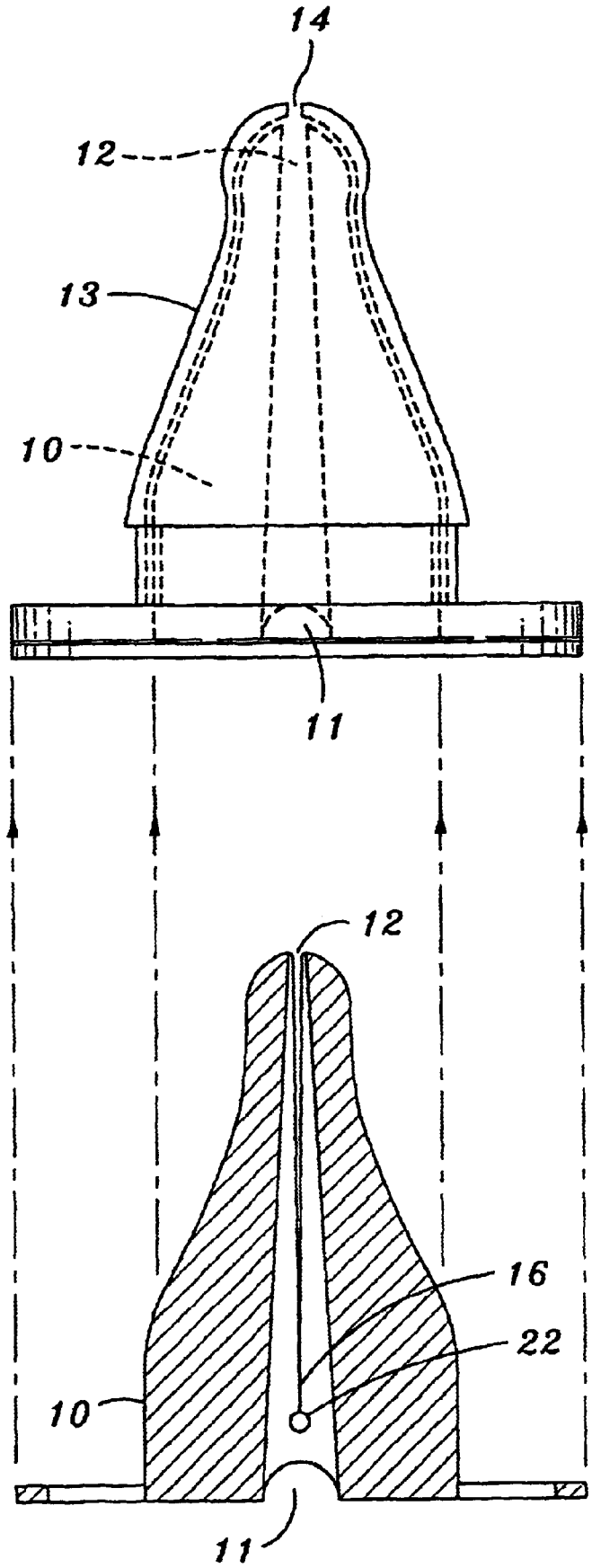
FIG. 4*a* is a cross sectional perspective view of the nipple and it is also shown in FIG. 4*b* in phantom outline inside the cavity of a prior art on common nipple.

Prior art nipples enable nipple 10 to be forced inside of cavity of prior art nipples as manner of entry is described in FIG. 4. Nipple 10 of the present invention is held inside of prior art nipples by friction. The pinhole 14 of nipple 13 prevents fluids from escaping from container, other than by sucking, when such container is turned opposite gravity pull. Pinhole 24 may be enlarged to suit the flow of liquids on foods. The top of nipple 10 may be cut to accommodate inner cavity of nipples of prior art without destroying or altering function of the nipple of the present invention. The slit 16 on cut as illustrated in FIG. 2 allows operation to thoroughly clean nipple 10 of the present invention. Nipple 10 can be cut in half and still remain functional as of the present invention. If such a manner deems necessary nipple 10 would be inserted into nipples of prior art and the straw 25 can then enter tapered cavity as nipple 13 contains nipple 10. Cavities 15 as illustrated in FIG. 2 at base 26 make way for the functions of nipple as described in U.S. Pat. No. 2,960,088. FIG. 4, hole 22 is slit 16 stop hole.

Figure 5:
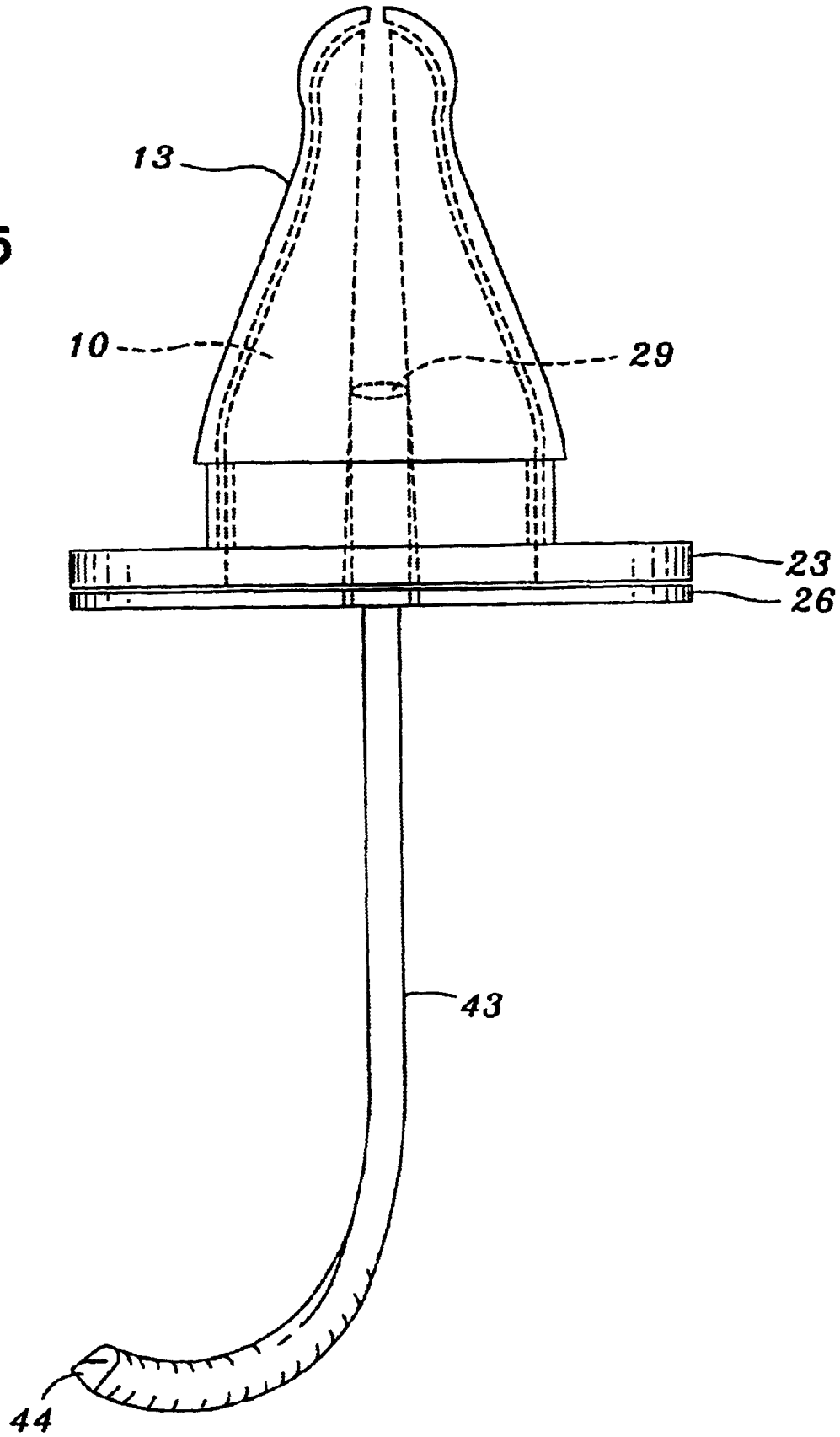
FIG. 5 shows a common nipple with the nipple, according to this invention, shown in phantom outline with common plastic drinking straw inserted, in phantom outline, in the nipple of this invention.

FIG. 5 illustrates a nipple of prior art, the nipple of the present invention, in broken lines, and a drinking straw inserted and illustrated by broken lines, is frictionally held by the tapered cavity of the nipple of the present invention. The two bases 23 and 26 of the two nipples 10 and 13 are compressed by the collar skirt 21 of collar 17 to container 20. Straw terminates at point 29.

Figure 7A:
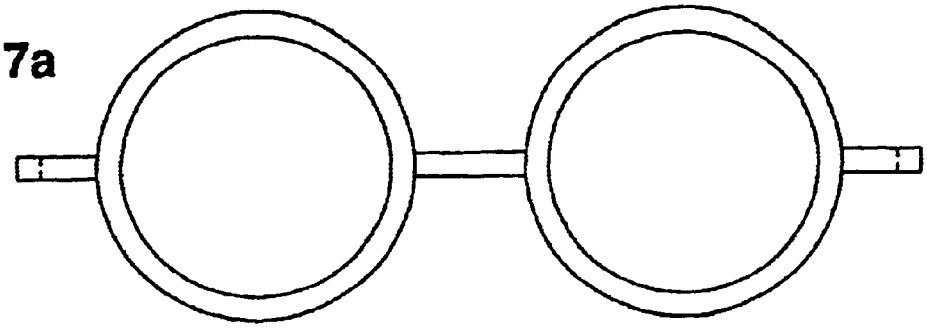
FIGS. 7*a, b, c* shows top, front and bottom views respectively of two common baby bottles as one with mind-keys secured to the grip handles according to this invention.
Figure 7B:
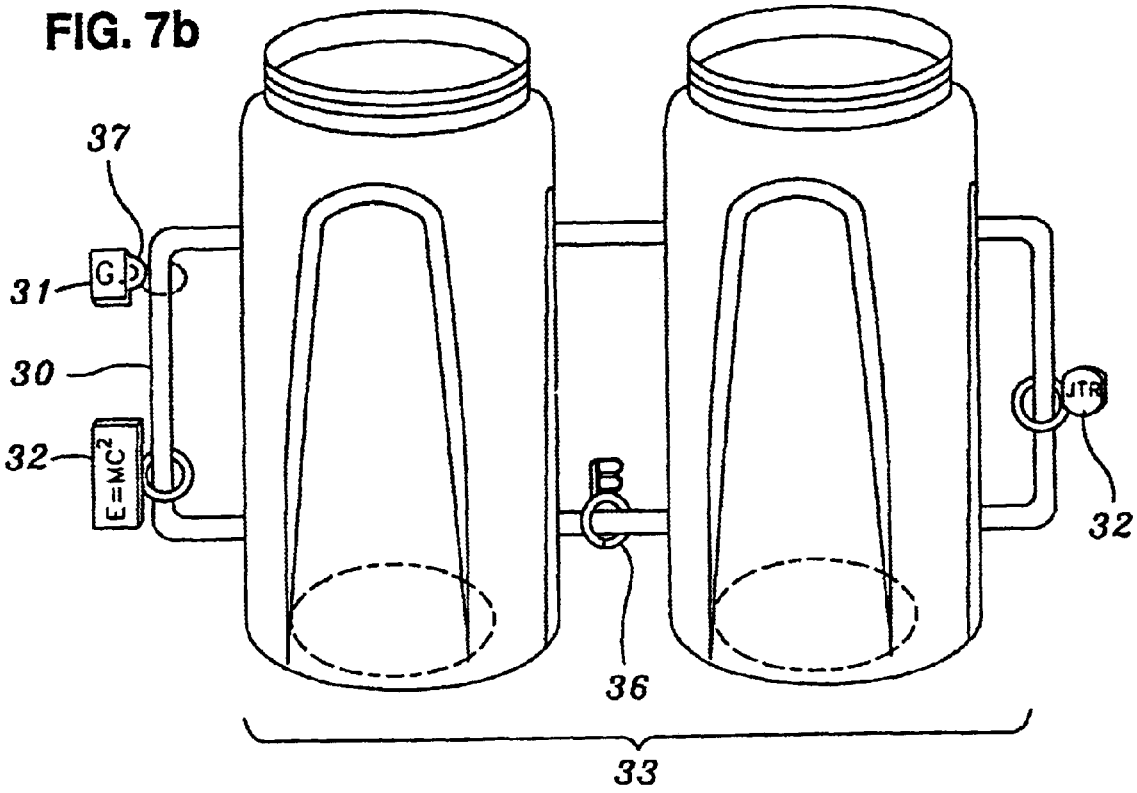
Figure 7C:
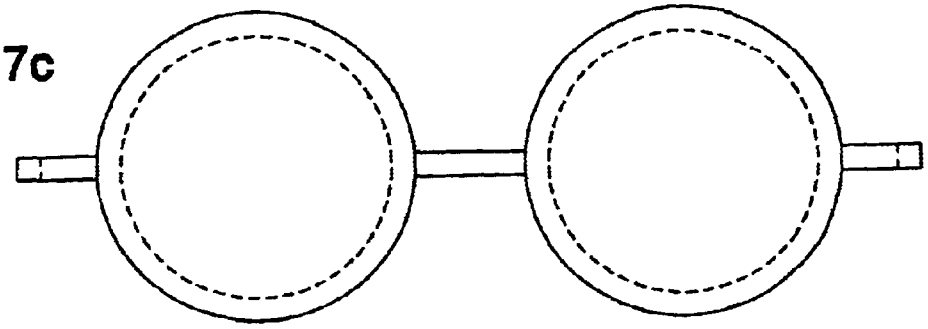

FIG. 7 illustrates two bottles 33 as one of the present invention. This embodiment allows baby to decide as to what fluids or foods to consume at times during feeding. Mothers, not being at fault,are mislead at babies demand for different fluids such as water. A lot of populus do not drink water and thus forgetting water is very common; this gives mothers to dispense both foods and water conveniently. Solid thin handles 30 enable baby to grip bottle, as dexterity is one of the first means of brain development. Prior art bottles with large hollow handles make cleaning of interior of bottles difficult. The large size of prior art handles make it next to impossible for baby's hands to grasp. Mind keys 31 enable baby to see different shapes, feel different shapes with its tongue and feel different shapes with its fingers. The fingers, mouth and tongue are the first means of awareness as baby's mind develops. On mind keys 31 different figures 32 can be produced to further enhance mind development as baby's eyes begin to focus on different colors and illustrations. The ring split 36 on mind keys 31 of the present invention requires adult strength to remove and replace different modes of mind keys for mind development. A common key chain 37 is another means of attaching mind key for mind exercises.

Figure 8A:
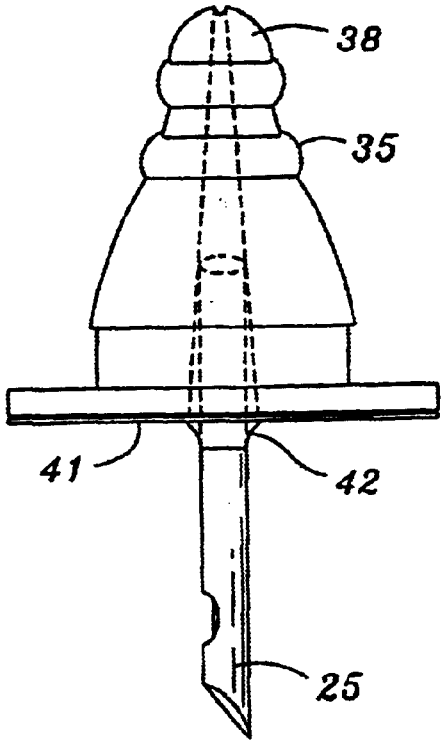
FIGS. 8*a* and 8*b* shows two plain view baby nipples according to this invention.
Figure 8B:
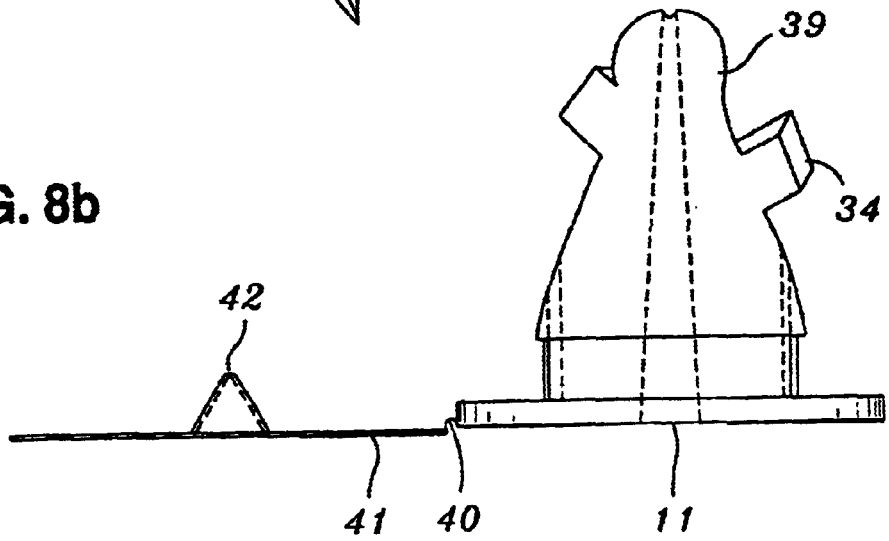
Figure 8C:
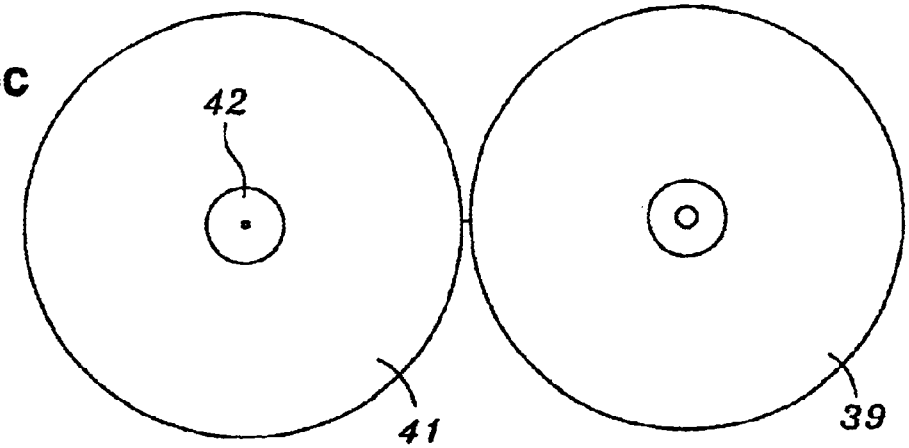

FIG. 8 illustrates nipples of two types for mind development of the present invention. Nipple 35 focuses on a soft protrusion and nipple focuses on a bold protrusion. The two nipples 34 and 35 let baby be aware of different structures because baby's first curiosity mode is its mouth. Later as child ages and starts to develop teeth, protrusion 34, according to this invention will act as a teething tool. Nipple 38 and 39 are solid nipples with a tapered hole through the center of it. Hole 11 is at the base and then terminates with the smaller hole at the top of the nipple. The tapered hole provides easy cleanability and/or being made out of an inexpensive plastic such as polyethylene may be discarded after each use. The hole at the top of the nipple is large enough to accept a cleaning tool such as a small nipple brush. The semi-solid teething nipple 38 and 39 of the present invention helps prevent baby from biting off the top portion of the nipple due to the structure I have invented. Nipples of prior art are very thin-walled and are easily bitten off during the teething stage of development causing choking and even death. Baffle 41 is molded along with nipples 38 and 39 and is so attached by "living hinge" 40. The baffle is punctured 42 as to restrict the flow of the liquids of the container. This baffle is necessary due to the large cleanable hole at the top of the teething nipple. Baffle 41 can also be cut to hold and secure a common drinking straw of any diameter as illustrated in plain view of nipple 38. Nipple 39 illustrates the nipple in the molded position. 40 is "Living hinge".

Figure 9:
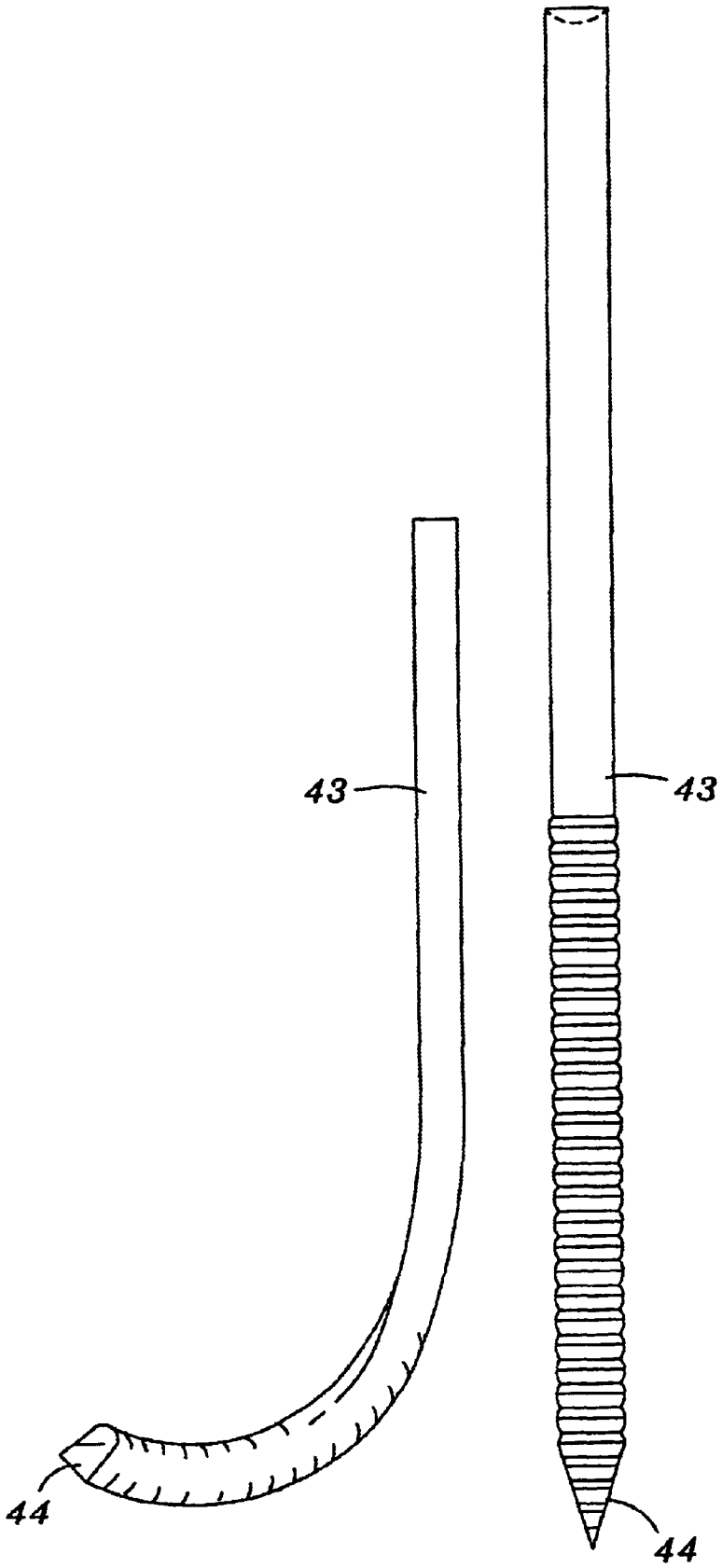
FIG. 9 shows baby bottle expandable straws.

On FIG. 9 the straw 43 of the present invention enables mother to pull the straw to a desired length. If the straw is too long tip 44 will allow the end of straw to follow the contour of the bottles bottom and corners.

I claim:

1. A nipple for a baby bottle containing a fluid, the nipple comprising:

a substantially solid nipple having a substantially solid cross-section, an outer surface, base, a top, and a pinhole formed at the top of the nipple; and a tapered cavity extending through the nipple and becoming progressively narrower from the base to the pinhole, to receive and fictionally engage a drinking straw within the tapered cavity;

said solid cross-section defines a thickness between the tapered cavity and said outer surface, said thickness being substantially reduced from said base to said pin hole along the tapered cavity.

2. The nipple as recited in claim 1 wherein the nipple is made from rubber.

3. The nipple as recited in claim 1 wherein the nipple is made of polyurethane.

4. The nipple as recited in claim further comprising a hollow nipple disposable upon the solid nipple.

5. The nipple as recited in claim 4 wherein the solid nipple and the hollow nipple are engagable to a collar.

* * * * *